US011246401B2

(12) United States Patent
Van Den Boogaard et al.

(10) Patent No.: US 11,246,401 B2
(45) Date of Patent: Feb. 15, 2022

(54) BODY CARE SYSTEM FOR COOLING A BODY PART

(71) Applicant: KONINKLIJKE PHILIPS N.V., Eindhoven (NL)

(72) Inventors: Maarten Van Den Boogaard, Heerenveen (NL); Bastiaan Johannes De Wit, Nuis (NL); Robert Godlieb, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/053,815

(22) PCT Filed: May 28, 2019

(86) PCT No.: PCT/EP2019/063704
§ 371 (c)(1),
(2) Date: Nov. 9, 2020

(87) PCT Pub. No.: WO2019/229008
PCT Pub. Date: Dec. 5, 2019

(65) Prior Publication Data

US 2021/0235857 A1 Aug. 5, 2021

(30) Foreign Application Priority Data

May 30, 2018 (EP) ..... 18174994

(51) Int. Cl.
*A46B 13/00* (2006.01)
*A45D 26/00* (2006.01)
*A46B 13/04* (2006.01)

(52) U.S. Cl.
CPC ..... *A46B 13/001* (2013.01); *A45D 26/0061* (2013.01); *A46B 13/04* (2013.01); *A45D 2026/009* (2013.01)

(58) Field of Classification Search
CPC ..... A46B 13/001; A46B 13/02; A46B 13/04; A46B 13/06; A45D 26/0061; A45D 2026/0049
See application file for complete search history.

(56) References Cited

U.S. PATENT DOCUMENTS 2,563,049 A 8/1951 Liebelt
4,943,176 A 7/1990 Baker
(Continued)

FOREIGN PATENT DOCUMENTS

FR 2849588 7/2004
FR 2918545 1/2009

OTHER PUBLICATIONS

International Search Report and Written Opinion dated Jul. 26, 2019 for International Application No. PCT/EP2019/063704 Filed May 28, 2019.

(Continued)

*Primary Examiner* — Todd J Scherbel

(57) ABSTRACT

The present invention relates to a body care system (100*a-j*) including a cooling device (10*a-j*) for a body care system (100*a-j*) comprising a brush unit (12) including a plurality of airflow generating structures, a connecting unit (16) for connecting the brush unit (12) to a driving unit (14), the driving unit (14) being configured to drive the brush unit (12) to rotate about a rotational axis (18) to generate an airflow by the rotation of the airflow generating structures, wherein the rotational axis (18) is substantially parallel to the surface of the body part, and a supplying unit arranged inside the brush unit (12) for supplying a cooling medium to the plurality of airflow generating structures of the brush unit (12) to evaporate the cooling medium by the generated airflow.

13 Claims, 5 Drawing Sheets

(56) References Cited

U.S. PATENT DOCUMENTS

| | | | |
|---|---|---|---|
| 5,849,018 | A | 12/1998 | Rosson |
| 7,435,029 | B1 | 10/2008 | Marini |
| 2003/0100936 | A1 | 5/2003 | Altshuler |
| 2006/0276731 | A1 | 12/2006 | Thiebaut |
| 2010/0331795 | A1 | 12/2010 | Jung |
| 2012/0022555 | A1* | 1/2012 | Sanchez-Martinez ..... B26B 19/40 606/133 |

OTHER PUBLICATIONS

Written Opinion of the International Preliminary Examining Authority dated Apr. 21, 2020 For Interantional Application No. PCT/EP2019/063704 Filed May 28, 2019.

International Preliminary Report on Patentability dated Aug. 12, 2020 FOR International Application No. PCT/EP2019/063704 Filed May 28, 2019.

* cited by examiner

BODY CARE SYSTEM FOR COOLING A BODY PART

CROSS REFERENCE TO RELATED APPLICATIONS

This application is the U.S. National Phase application under 35 U.S.C. § 371 of International Application No. PCT/EP2019/063704 filed May 28, 2019, which claims the benefit of European Patent Application Number 18174994.6 filed May 30, 2018. These applications are hereby incorporated by reference herein.

FIELD OF THE INVENTION

The present invention relates to a body care system for cooling a body part. It finds application in treatments of skin surface of humans and/or animals.

BACKGROUND OF THE INVENTION

In the body care or personal care domain, both for male and female users, there exist various examples of providing a cooling effect on a body part such as skin. For instance, active cooling and passive cooling are used for such purposes. Examples of active cooling include the use of Peltier elements, e.g. in puffy eye treatment devices, or Braun's CoolTech shaver. Examples of passive cooling include rotatable skin brushes and epilators in which a cooling element needs to be cooled (e.g. by placing the cooling element in a freezer) in advance of the treatment session.

A cooling device for body care such as skin care is able to provide both a treatment effect and a specific experience felt by the user. As treatment effect, the cooling may be used to remove or at least temporarily take away eye bags and wrinkles. It may also be used to treat or reduce skin irritations, e.g. those caused by shaving. Another benefit is the numbing of nerves prior to epilation. From the experience point of view, the cool feeling on the skin may give a feeling of calm and relaxation or a kind of pampering to the treated user. This can be the case with or without a combination of the cooling with other measures such as massaging.

Peltier elements are expensive in the context of personal care. Besides, the energy efficiency of Peltier elements is rather limited. Another challenging problem is that in a Peltier element next to a cool surface, also heat is generated. This heat needs to be removed away from the skin contact area as otherwise the user may have a feeling that the skin is being heated up. In order to avoid this, heat sinks or fans are needed, which make the cooling device more bulky and more expensive.

For passive cooling, the cooling element needs to be cooled down in advance to applying the cooling element to the user. This may be time-consuming. This means the user needs to schedule in advance when to place the cooling element in the freezer, or store the cooling element always in the freezer so it is ready for use at any time. This, however. takes up storage space in the freezer. Further, storing a cooling element in the freezer next to foods such as meat balls and left overs may not be found appropriate by the consumers.

US20100331795A1 suggests a hair removal device having a hair removal unit and a skin cooling unit, wherein the skin cooling unit has a skin contact surface, and the skin cooling unit is equipped to apply an application substance onto the skin by way of the skin contact surface during use of the hair removal device.

U.S. Pat. No. 5,849,018 A discloses a mechanical epilator for pulling hairs from the skin, the epilator including an epilator member, e.g., constituted by a roller made up of disks and of blades, that is rotatable about an axis and that is driven by an electric motor, in association with a mechanical coupling member.

US 2006/276731 A1 discloses an appliance or device for massaging and/or dispensing a cosmetic product held in a container mounted on a housing of the appliance.

FR 2 849 588 A1 discloses an automatic foot washing device that is configured to wash one feet at a time or to wash to feet simultaneously.

FR 2 918 545 A1 discloses an assembly for the packaging and application of a cosmetic composition.

SUMMARY OF THE INVENTION

It is an object of the present invention to provide a body care system for cooling a body part which enables a less expensive, more energy efficient way of cooling a body part in body care such as skin care. The body care system can be implemented as a standalone device or integrated together with other functions, e.g. those of an epilator.

In a first aspect of the present invention a body care system for cooling a body part is presented that comprises a brush unit including a plurality of airflow generating structures extending radially outwards with respect to a rotational axis of the brush unit, a driving unit configured to drive the brush unit to rotate said brush unit about its rotational axis to generate, by the rotational motion of the airflow generating structures, an airflow in order to evaporate a cooling medium, wherein the rotational axis is configured to be substantially parallel to a surface of the body part during application of the body care system, a connecting unit connecting the brush unit to a driving unit, a supplying unit arranged inside the brush unit for supplying a cooling medium to the plurality of airflow generating structures of the brush unit to evaporate the cooling medium by the generated airflow, and a brush housing at least partially covering an outer surface of the brush unit, such that the surface of the body part to be cooled during application of the body care system and the brush unit covered by the brush housing are physically separated from each other by a part of the brush housing during application of the body care system.

Preferred embodiments of the invention are defined in the dependent claims. It shall be understood that the claimed system has similar and/or identical preferred embodiments as the claimed device and as defined in the dependent claims.

The body care system may be a stand-alone device or integrated into a body care system. The brush unit is drivable by the driving unit (e.g. of a body care system) to carry out rotational motions. For this, the connecting unit is provided to connect the brush and the driving unit. The connecting unit may be arranged as e.g. a joint for accommodating a rotation shaft extending from the driving unit (e.g. a motor). Fixation means (e.g. threads and/or screws) may be provided to rotatably fix the shaft at the brush unit so that the shaft is rotatable about the axis of the brush unit but fixed with respect to the brush regarding the motion in the direction along the shaft.

The plurality of airflow generating structures may comprise, without being limited to, filaments, fibers, flaps, etc.

Further, the plurality of airflow generating structures may be of the same in length and/or width. The filaments may comprise the same of different materials such as textile, plastic, rubber and the like. In the following, the present invention is described using the exemplary but non-limiting embodiments where filaments are utilized as airflow generating structures.

The supplying unit is adapted to supply the cooling medium, e.g. water or another cooling liquid, to the filaments. Different types of supplying unit are thinkable for the present invention as long as the cooling medium can reach the filaments of the brush unit. Preferably, the cooling medium may be supplied in between the filaments. The supplying unit may be adapted so as to apply a predefined amount of the cooling medium to one or more of the filaments. The supplying unit may comprise a reservoir containing the cooling medium arranged within the brush unit or in a vicinity of the brush unit.

When the body care system is brought into close proximity of a surface of a body part of a user (e.g. skin surface) and when the device is held so that the rotational axis is aligned to be parallel to the skin surface, the rotational motions carried out by the plurality of filaments of the brush unit is capable of caressing or massaging the skin surface. Similar effects may be achieved when the body care system is held so that the rotational axis is aligned to be oblique to the skin surface, as long as the contact between the brush unit and the skin surface is maintained.

Due to rotational motions of the brush unit, the filaments of the brush unit and thus also the cooling medium supplied to the brush unit from the supplying unit carry out a rotational motion about the rotational axis parallel to the skin surface. This may lead to cooling of the skin surface.

In this context, the expression "substantially parallel" shall be understood such that the inclined angle between the surface of the body part and the rotational axis is less than ±10° when the body care system is used and held as intended. Due to the rotational motion of the brush unit the filaments (i.e., the airflow generating structures) carry out a rotational motion about the rotational axis being substantially parallel to the skin surface. This leads to cooling as the rotation of the filaments (which are in contact with the skin surface) generates an airflow on the skin. If the rotational axis were arranged perpendicular to the skin surface (i.e., if the body care system were used and held incorrectly) the rotation of the brush unit including the filaments would not generate an efficient airflow for cooling the skin surface. The orientation of the rotational axis with reference to the skin surface and the intended use of the body care system by a user will be explained below in more detail with reference to the figures.

In particular, the cooling medium at the filaments of the brush unit experiences an airflow since the cooling medium rotates and thus carries out a relative motion with respect to the surrounding air. This causes evaporation of the cooling medium during which heat is absorbed from the cooling medium. This cools down the filaments locally. Via contact between the filaments and the skin surface, the cold (lower temperature) is transferred to the skin surface.

The cooling may occur by another mechanism: the rotation of the filaments generates an airflow on the skin surface in close proximity to the brush unit. Also, the cooling medium supplied from the supplying unit to the filaments may arrive at the skin surface due to contact between the brush unit and the skin. Thus, the airflow on the skin surface causes evaporation of the cooling medium on the skin surface, thereby cooling down the skin surface locally.

These two mechanisms are not limiting for the present invention. For instance, the airflow caused by the rotation of the filaments in the other mechanism above may cause evaporation of cooling medium that has been brought to the skin surface prior to rotation of the filaments.

The present invention uses a compact design and achieves cooling effectively.

At least a part of the brush housing is arranged between the outer surface of the brush unit and the user when applying the body care system in conjunction with a body care system such as a skin treatment device or epilator. In this way, the skin surface of the user and the brush unit covered by the brush housing are physically separated from each other during application of the body care system. Thus, a direct physical contact between the skin surface and the cooling medium such as water can be avoided. The skin is thus not affected or moistened by the cooling medium from the filaments. Also, a more cost-efficient alternative of indirect body care system to a conventional Peltier element is realized.

In another preferable embodiment, the brush housing comprises a thermal conducting material. In this way, the cooling effect is established fast after switching on the device. A thermal conducting material may include, without being limited to, acrylic glass, fiber glass, metal, metal alloy, plastics, Teflon.

In still a further preferable embodiment, the thermal conducting material comprises a metal. Possible metals include, without being limited to, aluminum, copper, iron, steel and alloys consisting these metals. This enables a cost-efficient body care system.

In still a further preferable embodiment, the thermal conducting material has a thermal conductivity that is within a range from 20 to 400 W/(m·K). This enables fast establishing of the cooling effect after switching on the device. For instance, when the thermal conducting material comprises steel, the thermal conductivity may be approx. 20 W/(m·K). When the thermal conducting material comprises copper, the thermal conductivity may be approx. 385 W/(m·K).

In still a further preferable embodiment, the thermal conducting material has a specific heat capacity that is within a range from 0.35 to 0.95 J/g° C. This prevents cooling down of the brush housing immediately when bringing the body care system into contact with a skin surface (e.g. face of a human). For instance, when the thermal conducting material comprises copper, the specific heat capacity may be approx. 0.38 J/g° C. When the thermal conducting material comprises aluminum, the specific heat capacity may be approx. 0.90 J/g·° C.

In still a further preferable embodiment, the brush housing is formed to receive the brush unit from a body-facing side of the brush unit, the brush housing comprising a body-facing outer surface for covering the bottom surface of the brush unit, wherein the body-facing outer surface of the brush housing and the body-facing side of the brush unit are both facing towards the body part to be cooled during application of the body care system. The brush housing may take a cylindrical, rectangular or another form having a lateral side for (e.g. guidedly) receiving the brush unit and a bottom side for covering the bottom surface of the brush unit. This enables a compact design which is cost-efficient. The bottom side of the brush housing may comprise a flat or a slightly curved outer surface towards the skin surface during use of the body care system. This enables sufficient contact to the skin surface during use of the body care system so that the cooling is more efficient. Further, a flexible surface with proper thermal and mechanical properties is advantageous since such a surface may adapt to the curvature and/or contour of the skin surface. Such a flexible surface may be formed using e.g. aluminum or copper, preferably thin aluminum or copper foils. As an alternative to flexible it is also possible that the housing is fixed to the handle in a suspended way. Due to the suspension the housing can follow the curvature and/or contour of the skin surface independent from the movement of the handle and thus hand motion of the user.

In still a further preferable embodiment, the brush housing comprises at least one air venting opening. In this way, the evaporation process of the cooling medium from the filaments is enhanced during rotation of the brush unit. This increases the direct thermal exchange between the cooling medium from the filaments and the brush housing. Also, this improves the cooling effect during use on a skin. The air venting opening may be arranged on different sides of the brush housing such as, without being limited to, a lateral side or a top side. The number of venting openings may be preferably more than one so that air circulation is improved.

In still a further preferable embodiment, the at least one air venting opening comprises a lateral air venting opening. This enables effective cooling as well as easy production of the body care system.

In still a further preferable embodiment, the body care system further comprises a thermal connector attached to the body-facing side of the brush housing. This allows integration of the body care system together with another product function such as epilation or shaving. For instance, in case of an epilator, the thermal connector may comprise an inner cavity for accommodating the epilator rings. In this way, a cooling experience is possible and the impact on visibility on the other product function is limited. The thermal connector may have a thermal conductivity within the range from 20 to 400 W/(m·K).

In still a further preferable embodiment, the body care system further comprises a contact element for contacting a body part of a user. The contact element is attached to or belongs to the thermal connector. Preferably, the contact element is arranged at a bottom surface (i.e., a body-facing surface) of the thermal connector and may have a flat or curved form. The cooling effect is thus efficiently achieved. Further, a contact element having a flexible surface with proper thermal and mechanical properties is advantageous since such a surface may adapt to the curvature and/or contour of the skin surface. Such a flexible surface may be formed using e.g. aluminum or copper, preferably thin aluminum or copper foils. As an alternative to flexible it is also possible that the housing is fixed to the handle in a suspended way. Due to the suspension the housing can follow the curvature and/contour of the skin surface independent from the movement of the handle and thus hand motion of the user.

In still a further preferable embodiment, the supplying unit comprises a reservoir containing the cooling medium. This enables an integrated product which does not need an external container for storing the cooling medium.

In still a further preferable embodiment, the reservoir is arranged within the brush unit. This enables a short distance over which the cooling medium needs to be transferred until it reaches the filaments, thereby increasing the cooling efficiency since the part of the cooling medium in the vicinity of the filaments is higher. Also, the entire cooling medium is within the brush unit that is being cooled during rotation of the brush unit, so that loss of cold is reduced. The reservoir has preferably a plurality of openings for transferring the cooling medium to the filaments. The reservoir may have a circular cross-section so that the transfer of cooling medium is more homogeneous in different spatial directions.

Alternatively, another reservoir is arranged within a housing of a body care system comprising the driving unit. In this way, the size of the reservoir is not limited to the brush unit. Preferably, a liquid connection is provided between the reservoir and the brush unit for transferring the cooling liquid to the filaments.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
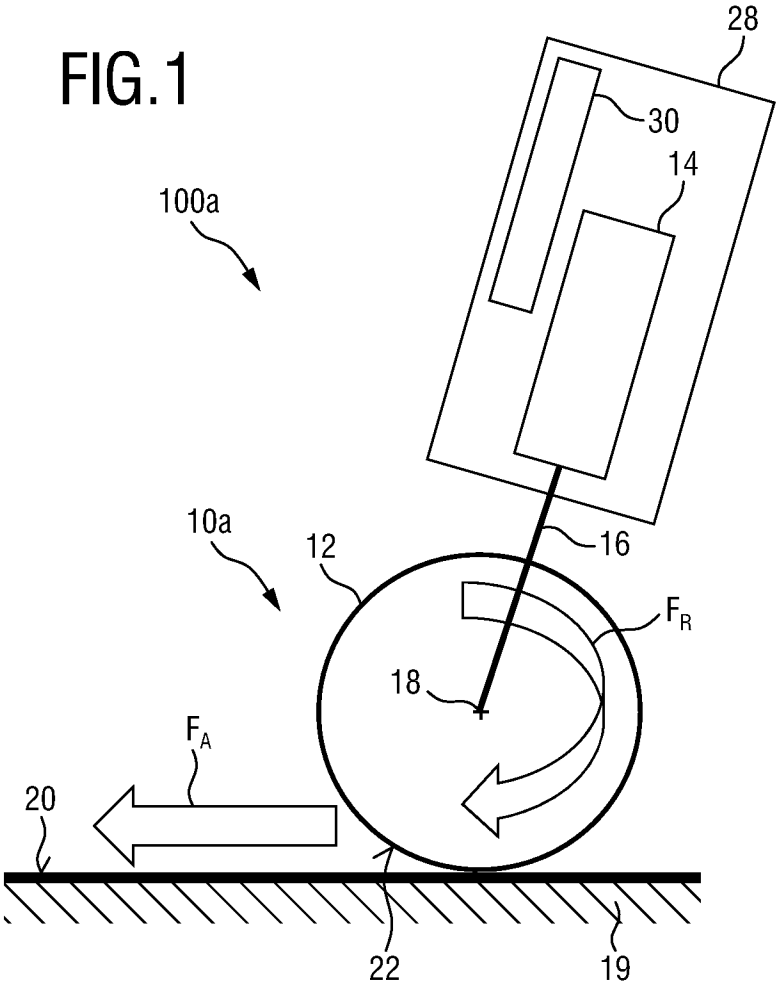
FIG. 1 shows schematically a cooling device in a body care system according to a first embodiment.

FIG. 1 shows schematically a cooling device 10*a* in a body care system 100*a* according to a first embodiment. The cooling device 10*a* comprises a brush unit 12 which is rotatable about a rotational axis 18. The brush unit 12 thus forms a roller. In the position of the body care system 100*a* exemplarily shown in FIG. 1, the rotational axis 18 extends substantially parallel to a skin surface 20 of a user skin 19, so that the rotational motion is perpendicular to the skin surface 19. The brush unit 12 comprises a plurality of airflow generating structures such as, but not limited to, filaments, fibers, flaps, etc. (not shown in FIG. 1, but exemplarily shown by a plurality of filaments 23 shown in FIG. 4 for all possible embodiments) that extend radially outwards with respect to the rotational axis 18. These airflow generating structures can comprise materials like textile, plastic, rubber and the like.

Hereby, "substantially parallel" shall be understood such that the inclined angle between the skin surface 19 and the rotational axis 18 is less than ±10°. Due to the rotational motion of the brush unit 12, the filaments carry out a rotational motion about the rotational axis 18 being substantially parallel to the skin surface 19. This leads to cooling as the rotation of the filaments being in contact with the skin surface 19 generates an airflow on the skin in close proximity to the brush unit 12.

In FIG. 1, the contour of the brush unit 12 comprising the filaments/bristles are schematically shown in a side view. The brush unit 12 is connected to a connecting unit 16 which is attached to a driving unit 14, e.g. a motor, accommodated within a housing of the body care system 100*a*, so that the motor 14 can drive the connecting unit 16 and thus the filaments to rotate about the rotational axis 18. The rotational motion is indicated by a circular arrow $F_R$.

The filaments may extend directly from the axis 18 radially outwards, or be arranged on a rotor element drivable by the driving unit via the connecting unit 16. By rotation driven by the motor 14, the filaments rotate with respect to the surrounding air and creates an airflow on the skin surface 20 in the vicinity of the brush head 12. In the example shown in FIG. 1, the rotation of the brush unit 12 is close-wise, wherein the direction of the airflow created is indicated by a straight arrow $F_A$.

A cooling medium is supplied to the filaments by a supplying unit (not shown in FIG. 1). The supplying unit may be configured to pre-moisturize the filaments and/or the skin surface. The cooling medium may be water or another cooling liquid. In the following, the present invention will be described using water as cooling medium. This is, however, not limiting for the present invention as numerous other cooling media/liquids/moistures are also thinkable. When the cooling is to be integrated into a cleansing device, a cleanser liquid is preferred. For giving the skin a softer feeling, other liquids such as e.g. oils can be used. Further, one or more scents (e.g. menthol) can be added to the cooling liquid that enhance the cooling perception.

When water is supplied to the filaments, the rotation of the filaments leads to a relative motion between the water and the surrounding air, which accelerates the evaporation of the water and results in temperature decrease and thus cooling of the brush unit 12. Also, the airflow created (arrow $F_A$) accelerates the evaporation of the water on the skin surface 19 close to the brush unit 12. Both mechanisms result in cooling of the skin surface: the first mechanism results in temperature decrease of the spot on the skin surface 19 directly contacted by the brush unit 19, whereas the second mechanism results in temperature decrease of the area on the skin surface 19 close to the contact spot.

Preferably, the skin surface 19 is moisturized by pre-moistening the cooling device 10*a*, in particular the brush unit 12 and then sputtering the moisture onto the skin surface 19. For instance, the roller of the brush unit 12 is pre-moistened with water and, by the rotational movement perpendicular to the skin surface 19, sputters the water to the skin surface 19. The sputtering process is preferably a fine mist spray, which pre-moisturizes the skin and makes evaporation of the moisture easier.

The amount of airflow is an important parameter for the amount of liquid being evaporated and thus for the cooling realized. Other important parameters include the filament length (typical values: 0.1-2 cm), the diameter of the roller (typical values: 1-10 cm), the rotational speed (typical values: 5000-40000 rpm) and the spray pattern resulting from the above-mentioned parameters. Preferably, these parameters can be controlled to create an optimized or preferred cooling effect. Independent of the selected parameter values, a cooling effect arising due to the evaporation of the cooling liquid, can be detected. This is advantageous over known systems which utilize completely different approaches. In particular, using a brush that rotates perpendicularly to the skin surface instead of in parallel to the skin surface yields a significantly improved cooling effect.

The body care system 100*a* comprises the housing 28 and the brush unit 12 connected to the motor 14 by the connecting unit 16. The housing 28 further includes a power supply unit 30, e.g. battery. The housing 28 is preferably a housing for a hand-held apparatus. The body care system 100*a* may be for skin care, epilation, skin grooming, shaving, without being limited to these examples.

Figure 2:
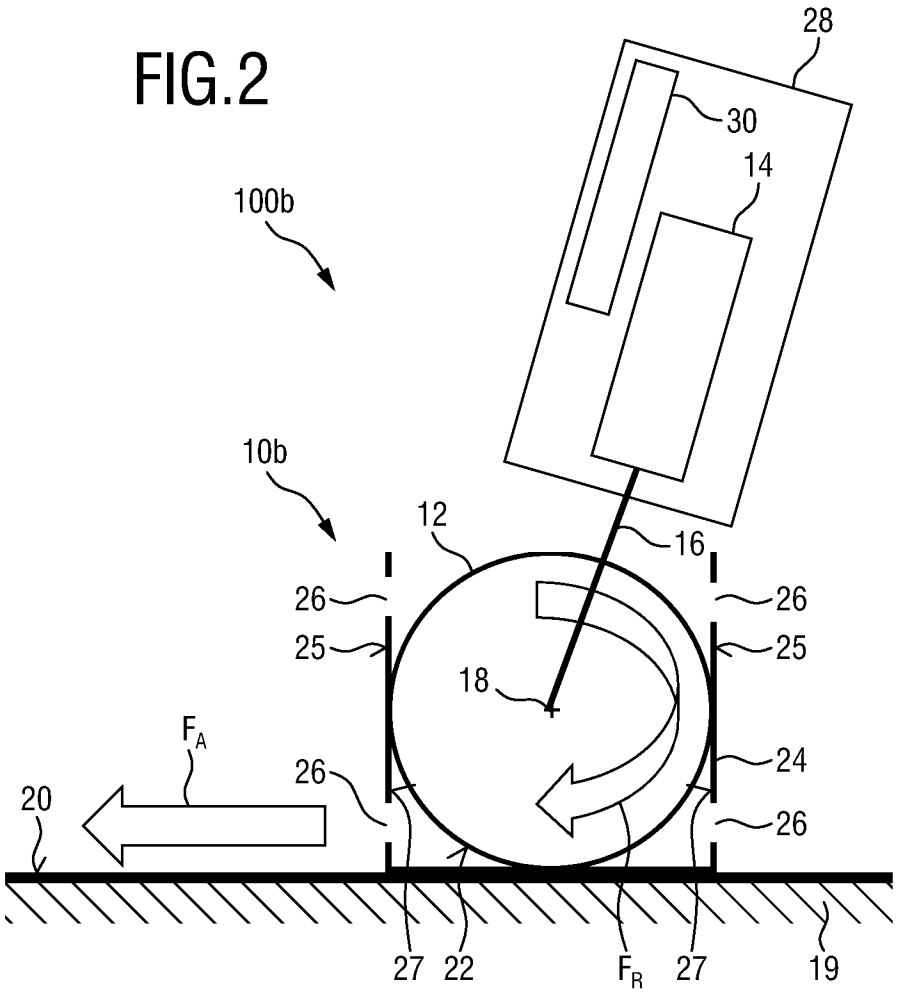
FIG. 2 shows schematically a cooling device in a body care system according to a second embodiment.

FIG. 2 shows schematically a cooling device 10*b* in a body care system 100*b* according to a second embodiment. In difference to the embodiment shown in FIG. 1, the cooling device 10*b* of FIG. 2 comprises further a brush housing 24 for receiving the brush unit 12. The brush housing 24 is exemplarily formed as a cylindrical cover with a bottom side facing the skin surface 20 during use and a lateral side 25, on which a plurality of air venting openings 26 are formed. Preferably, a top side closure (not shown) is provided to close the brush housing 24 at its top side e.g. for preventing components from being trapped in between the rotating brush unit 12 and the brush housing 24, alternatively or additionally for preventing the same between the rotating brush unit 12 and the housing 28 of the body care system 100*b*. The connecting unit 16 preferably extends through an opening formed on the top side closure so that the components within the brush housing 24 are not visible and/or touchable by the consumer.

Using the embodiment shown in FIG. 2, it is possible to cool the skin 19 in an indirect manner (compared to the direct cooling shown in FIG. 1). In particular, the evaporation of the cooling liquid supplied to the filaments as described with FIG. 1 leads to temperature decrease of the brush unit 12. Since the brush unit 12 is in contact with the brush housing 24, the cold can be further transferred to the brush housing 24 and from the latter further to the skin surface 20 via a bottom outer surface of the brush housing 24.

The airflow over this moisturized surface results in evaporation of the liquid resulting in a cooling effect.

Also, the air vents into the brush housing 24 and creates an airflow within the brush housing 24 (indicated by the straight arrow $F_A$) during rotation of the brush unit 12 (indicated by the curved arrow $F_R$). This leads to evaporation of the cooling liquid which has been sputtered from the filaments to an inner surface 27 of the brush housing 24 during the rotational motion. This results in a temperature decrease of the brush housing 24, wherein the cold is further transferred to the skin surface 20.

In contrast to the embodiment shown in FIG. 1 (direct cooling), the skin surface 20 does not enter direct contact with the cooling medium (indirect cooling). Advantageously, the likelihood that the skin 19 itself is affected, cleaned or moistened is avoided or at least reduced. Also, a cost-efficient alternative of indirect cooling device is enabled to e.g. Peltier elements.

Preferably, the brush housing 24 comprises a material having a high thermal conductivity so that the cooling effect can be achieved fast after switching on the cooling device 10*b*. The thermal conductivity may be within a range from 20 to 400 W/(m·K). This enables fast establishing of the cooling effect after switching on the device. For instance, when the thermal conducting material comprises steel, the thermal conductivity may be approx. 20 W/(m·K). When the thermal conducting material comprises copper, the thermal conductivity may be approx. 385 W/(m·K).

Further preferably, the brush housing 24 comprises a material having a high specific heat capacity so that it is ensured that the brush housing 24 does not cool down immediately when being brought into contact with the skin surface 20. The specific heat capacity may be within a range from 0.35 to 0.95 J/g·° C. This prevents cooling down of the brush housing immediately when bringing the cooling device into contact with a skin surface (e.g. face of a human). For instance, when the thermal conducting material comprises copper, the specific heat capacity may be approx. 0.38 J/g·° C. When the thermal conducting material comprises aluminum, the specific heat capacity may be approx. 0.90 J/g·° C.

The addition of cooling medium to the brush unit 12 (i.e. roller) can be achieved in general from the outside, by pre-wetting or -moisture, e.g. by holding the roller under a liquid (e.g. water) tap.

Figure 5:
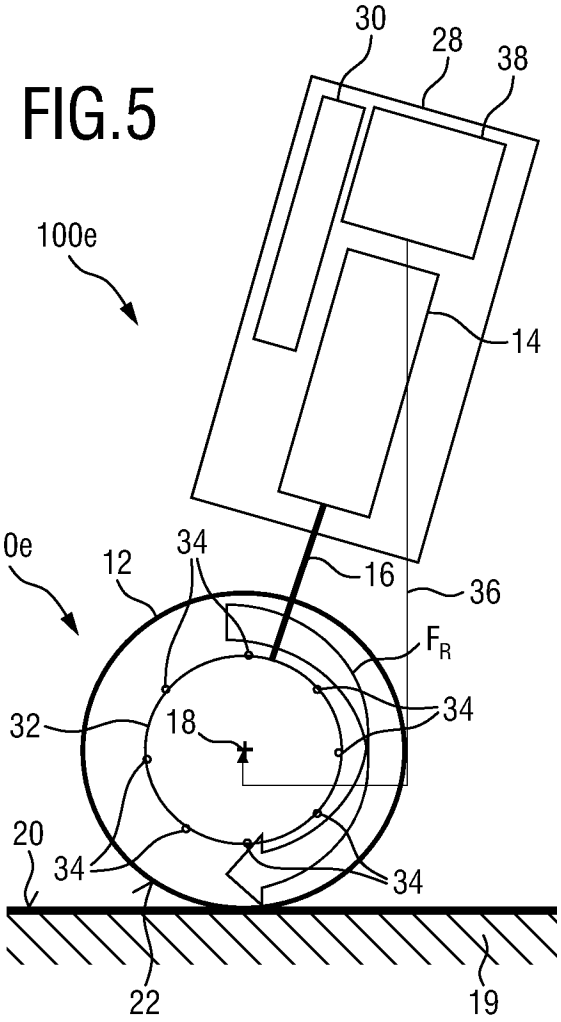
FIG. 5 shows schematically a cooling device in a body care system according to a fifth embodiment.
Figure 4:
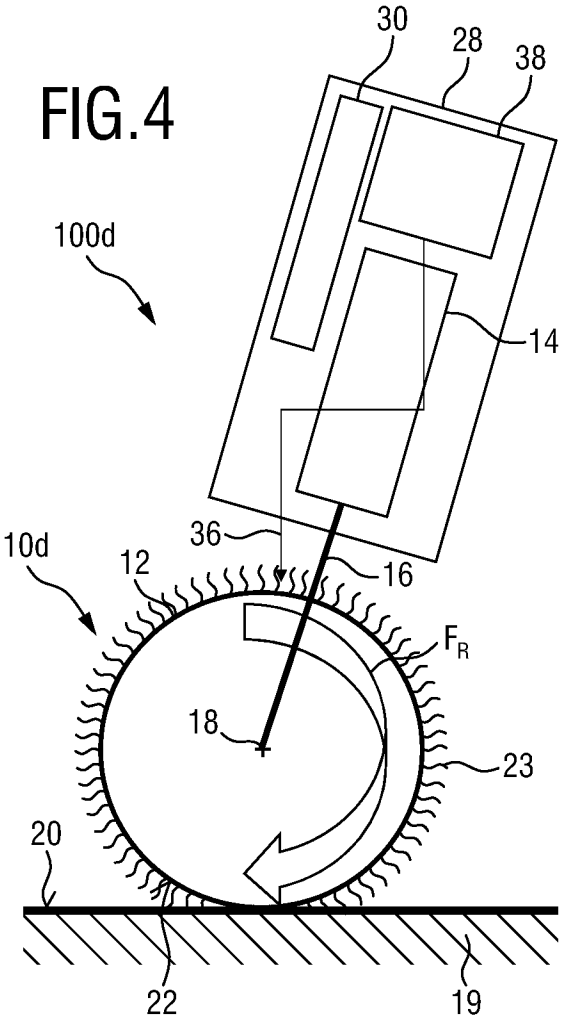
FIG. 4 shows schematically a cooling device in a body care system according to a fourth embodiment.
Figure 3:
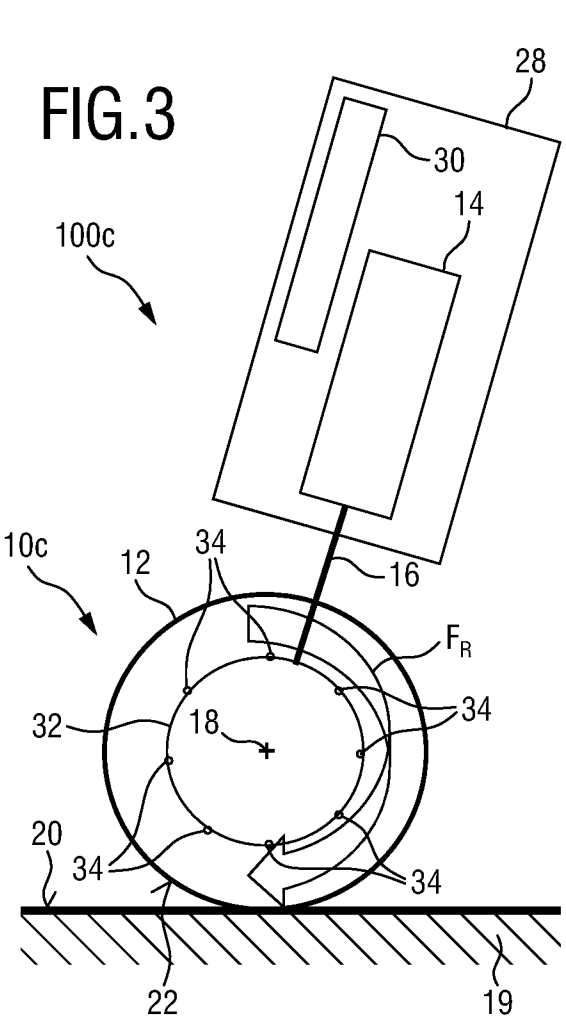
FIG. 3 shows schematically a cooling device in a body care system according to a third embodiment.

FIGS. 3-5 show each schematically a cooling device 10*c, d, e* in a body care system 100*c, d, e* according to a third, a fourth and a fifth embodiment, respectively.

In these embodiments, the respective cooling device 10*c-e* constitutes a direct cooling device in analogy to that of FIG. 1, but differs from the latter in that the supplying unit further includes a reservoir 32, 38 for containing the cooling medium. The reservoir 32 in the embodiment shown in FIG. 3 is arranged within the brush unit 12. The reservoir 38 in the embodiment shown in FIG. 4 is arranged within the housing 28 of the body care system 100*e* external to the brush unit 12, wherein a liquid connection 36 is provided to transfer the cooling liquid from the reservoir 38 to the brush unit 12, in particular to a plurality of liquid channels (not shown) within the brush unit 12.

In the embodiment shown in FIG. 5, two reservoirs 32, 38 are included, wherein a first reservoir 38 is arranged within the housing 28 of the body care system 100*e* and a second reservoir 32 is arranged within the brush unit 12. A liquid connection 36 is also provided to transfer the cooling liquid from the first reservoir 38 to the filaments in the brush unit 12 and/or to the second reservoir 32.

In the preferable embodiments shown in FIGS. 3 and 5, a plurality of openings 34 are formed on the surface of the reservoir 32 (FIG. 3) and the second reservoir 32 (FIG. 5), respectively, to allow transferring of cooling medium to the filaments from the reservoir 32. Preferably, the reservoir 32 is defined by an inner surface of the roller and the openings 34 allow the cooling liquid to penetrate from the inner surface of the roller into the textile material (i.e. filaments) outside the reservoir 34. In this way, a continuous flow (e.g. dripping) of cooling liquid from the inside of the roller to the outside can be realized.

In the preferable embodiments shown in FIGS. 4 and 5, the reservoir 38 within the housing of the body care system 100*d, e* is used as a remote cooling liquid reservoir, from which liquid is transported to the channels (FIG. 4) or to the second reservoir 32 (FIG. 5) in the inside of the roller. Advantageously, the size of the reservoir 38 is not limited to the brush unit 12.

The reservoirs 32, 38, the liquid connection 36 as well as the liquid channels are preferably part of the supplying unit.

Preferably, the reservoir 32 has a cross-section (e.g. circular as shown in FIG. 3 and FIG. 5) centered at the rotational axis 18 and/or the openings 34 are distributed over the circumference of the reservoir 32 with respect to the rotational axis 18. This is advantageous for a homogeneous distribution of the, to be evaporated, cooling medium to the filaments through the openings 34, leading to an equal wetting of all airflow generating structures.

Figure 8:
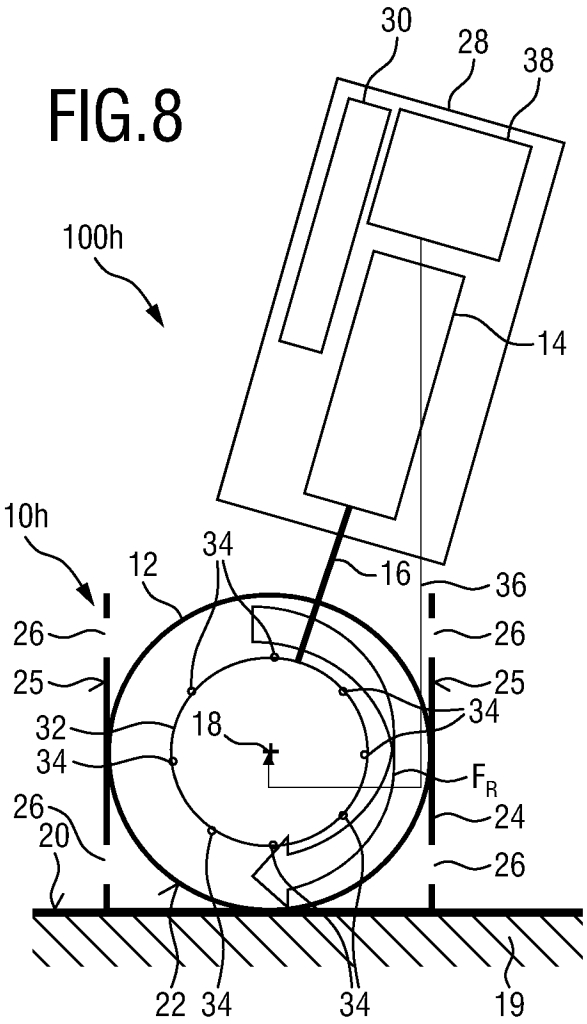
FIG. 8 shows schematically a cooling device in a body care system according to an eighth embodiment.
Figure 7:
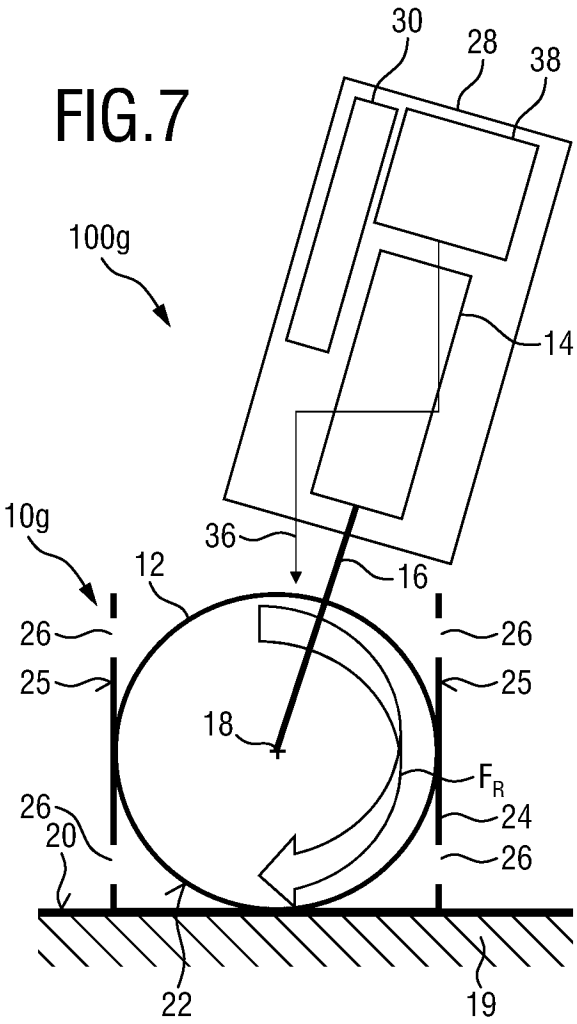
FIG. 7 shows schematically a cooling device in a body care system according to a seventh embodiment.
Figure 6:
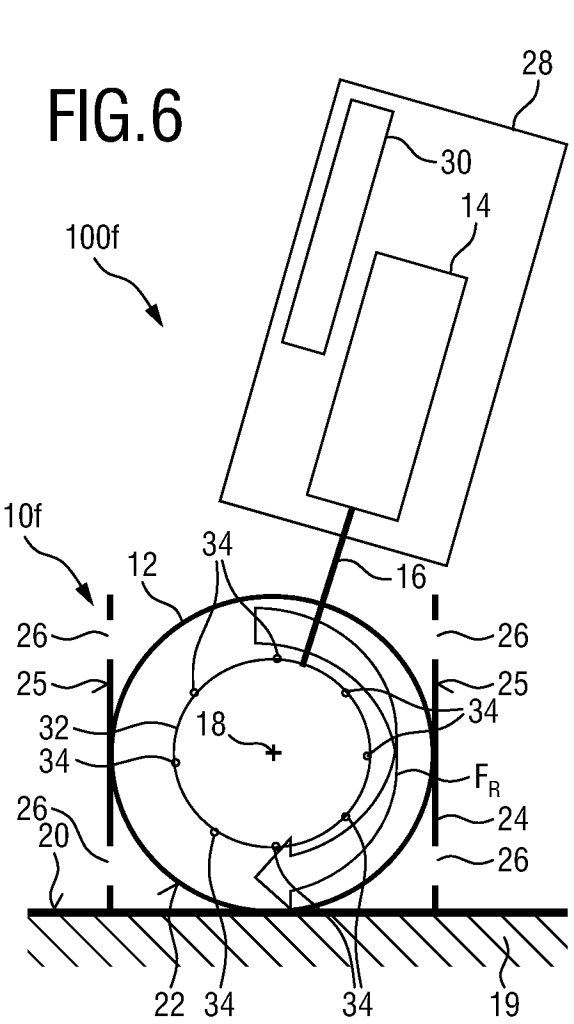
FIG. 6 shows schematically a cooling device in a body care system according to a sixth embodiment.

FIGS. 6-8 show each schematically a cooling device 10*f, g, h* in a body care system 100*f, g, h* according to a sixth, seventh and eighth embodiment, respectively.

In these embodiments, the cooling device 10*f-h* differs from the embodiments shown in FIGS. 3-5 in that the respective brush unit 12 is received by a brush housing 24 as described in FIG. 2. In this way, an indirect cooling device in analogy to that of FIG. 2 can be achieved with the additional advantage of a cooling medium reservoir whose size is not limited by the brush unit 12 and/or the continuous flow (e.g. dripping) of cooling liquid from the inside of the roller to the outside.

Figure 9:
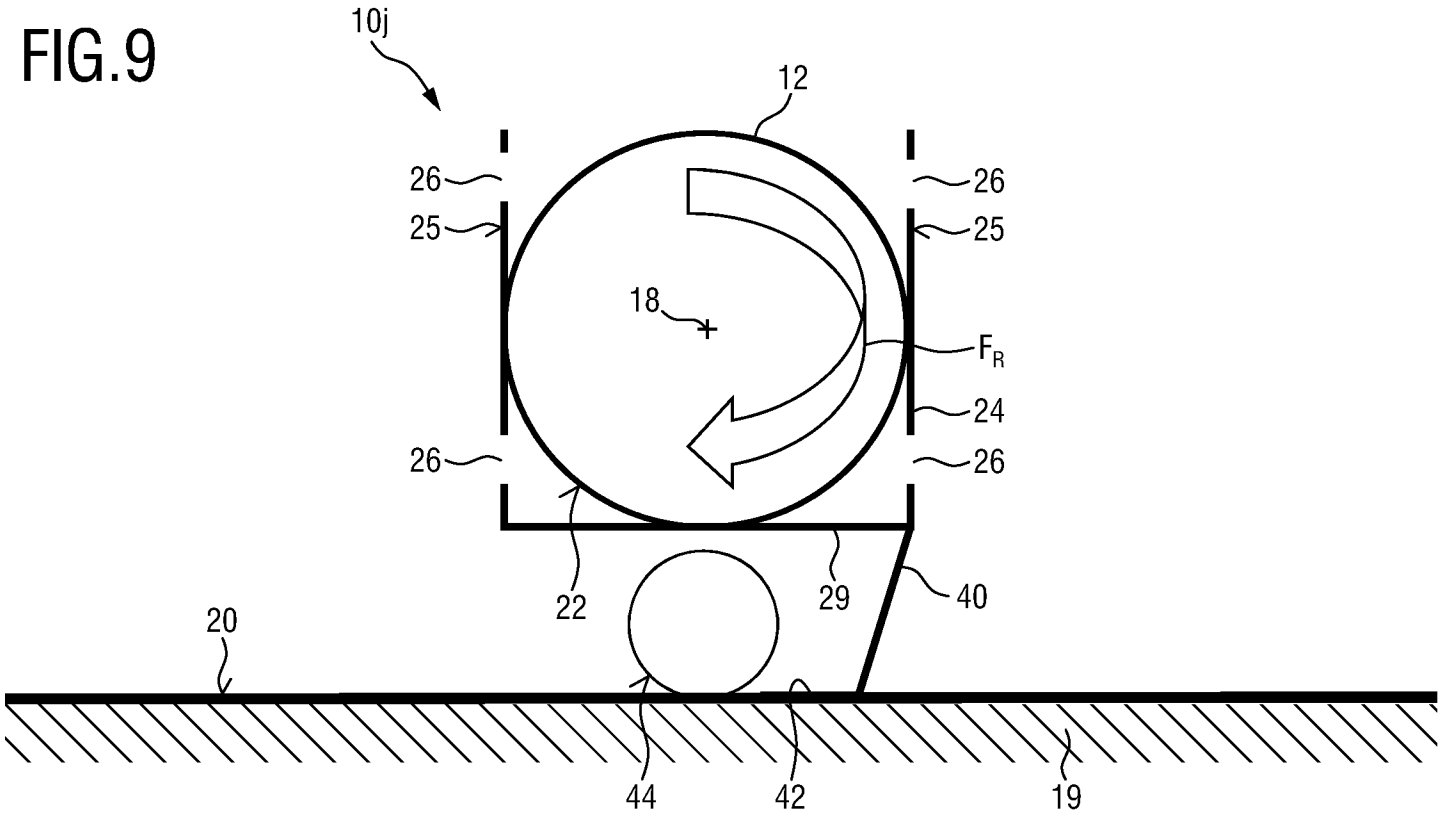
FIG. 9 shows schematically a cooling device according to a ninth embodiment.

FIG. 9 shows schematically a cooling device 10*j* according to a ninth embodiment. In this embodiment, the cooling device 10*j* further comprises a thermal connector 40 attached to the bottom side 29 of the brush housing 24. This allows integration of the cooling device 10*j* together with another product function such as epilation or shaving. For instance, as shown in FIG. 9, an epilator ring arrangement 44 having a plurality of epilator rings is accommodated within the thermal connector 40, so that both the epilator function and the cooling function are combined within one device.

The cooling effect in an epilator can be used to numb the nerves prior to an epilation session and in this way reduce the pain experience during epilation. The advantage of the integration is the much easier consumer routine, e.g. compared to the case where the user has to place an icepack in the freezer in advance of the epilation session.

The thermal connector 40 may have a thermal conductivity within the range from 20 to 400 W/(m·K).

Preferably, the thermal connector 40 comprises a contact element 42 for contacting the skin surface 20. As exemplarily shown in FIG. 9, the contact element 42 is preferably arranged on a bottom surface of the thermal connector 40 and may have a flat or curved form. The cooling effect is thus efficiently achieved. Further, a contact element having a flexible/elastic surface with proper thermal and mechanical properties is advantageous since such a surface may adapt to the curvature and/or contour of the skin surface. Such a flexible surface may be formed using e.g. aluminum or copper, preferably thin aluminum or copper foils. As an alternative to flexible it is also possible that the housing is fixed to the handle in a suspended way. Due to the suspension the housing can follow the curvature and/or contour of the skin surface independent from the movement of the handle and thus hand motion of the user.

Alternatively, the contact element 42 may be a separate part attached to the thermal connector 40. The thermal connector 40 and/or the contact element 42 are preferably provided to only laterally enclose the epilator ring arrangement 44 while a direct contact between the epilator rings and the skin surface 20 is enabled. Instead of the epilator ring arrangement 44, another functional unit (e.g. shaver, grooming element, etc.) can be placed and integrated into the cooling device 10*j* in the same manner. In this case the cooling effect can be used to reduce skin irritation. Advantageously, a more cost-efficient alternative to e.g. Peltier elements is realized.

Figure 10:
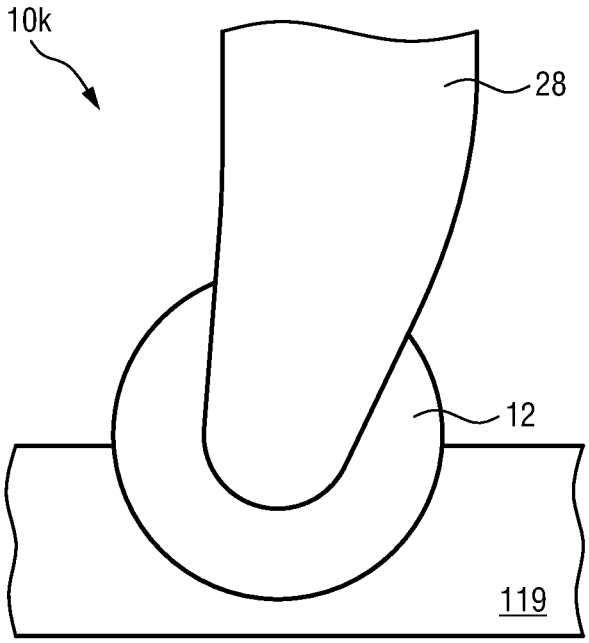
FIG. 10 shows schematically a cooling device according to a tenth embodiment.
Figure 11:
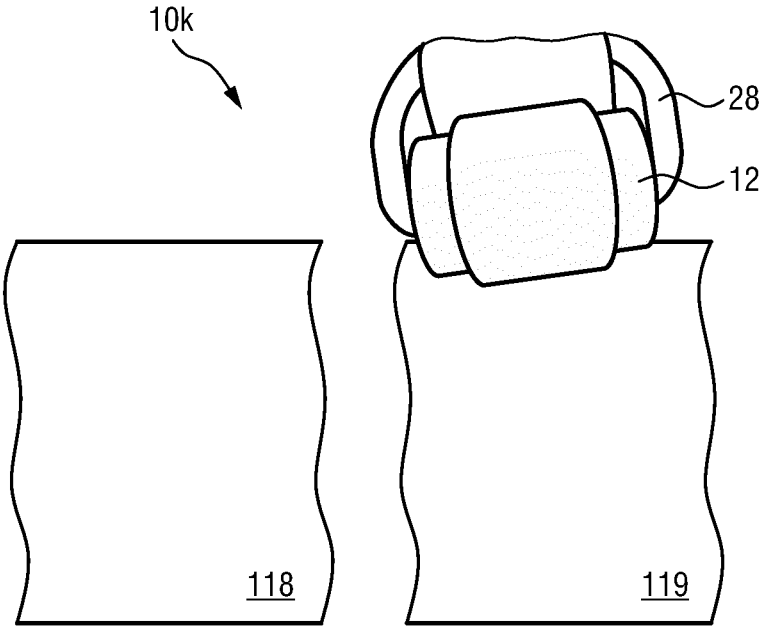
FIG. 11 shows schematically the cooling device according to the tenth embodiment in another view.

FIGS. 10-11 show schematically a test of cooling a metallic surface using a cooling device 10*k* according to a tenth embodiment. The brush unit 12 (rotating roller) comprising a plurality of filaments is rotatably attached to the housing 28 of the body care apparatus. As exemplarily shown in FIGS. 10-11, the cooling device 10*k* is held above a first metallic surface 119.

The roller is pre-moistened with water and positioned in such a way that the filaments just touched the surface of the first metallic surface 119. The roller is switched on for a test duration of 2 minutes. Separately from the first metallic surface 119 in contact with the rotating roller, a second metallic surface 118 of the same type is used to provide a reference.

The temperature is measured immediately before and after the test duration with an infrared thermometer on the first and second metallic surfaces 118, 119. A temperature decrease of more than 2° C. is registered. The initial temperature of the first metal spoon 119 is 25.4° C. and the temperature of the first metallic surface 119 after the test duration is 22.8° C. Over the same period, the temperature of the second (reference) metallic surface 118 remains the same, i.e. 25.4° C. Hence, a noticeable cooling effect for the skin is achieved while reducing the cost for fabrication.

Further, moistening of the rotating roller is crucial for the cooling effect. This is confirmed by another experiment in which a dry roller (not pre-moistened, instead of a pre-moistened roller) is used. No temperature effect can be detected in this case. This indicates that the cooling (i.e. temperature drop) is due to the evaporation of the moisture resulting from the airflow and not due to the airflow itself.

Also the rolling motion perpendicular to the surface to be cooled is crucial. This is confirmed by performing the experiment with a moistened cleansing device whose filaments rotate parallel to the surface (instead of perpendicularly as is the case in the test shown in FIGS. 10-11). No cooling effect can be detected in case of parallel movement or rotation of the filaments with respect to the surface to be cooled.

Hence, the cooling effect is realized by having an airflow over a moist surface. There are two reasons why rolling (i.e. rotation perpendicular to the surface) is preferred over rotation parallel to the surface. First, a rolling motion creates a mist cloud, by which small droplets of moisture are deposited on the surface to be cooled. With a rotating motion parallel to the surface to be cooled, less mist is created and the droplets are spread over a larger surface and away from the area to be cooled. Second, with a rolling motion there is a stronger airflow over the surface than with a rotating motion parallel to the surface to be cooled. This airflow results in the evaporation of the moisture layer on the surface.

The cooling effect created as described above can be used in at least two different ways. On one hand, it can be used to create a cooling effect before using another functional appliance (e.g. shaver, epilator). In this way, the skin surface feels cold at the beginning of using the other appliance, but not anymore during longer usage of the other appliance as the cooled surface is warmed up by contact between the other appliance (as well as surrounding air) with the skin. On the other hand, the described way of cooling can be used to maintain a cooling effect during usage of the other appliance. Due to the continuous cooling, the warming up of the skin surface as described above is compensated and the surface still feels cool during the whole usage cycle.

The present invention is advantageous over the direct cooling of (skin) surface that uses a passive cooling element which needs to be cooled (e.g. in the fridge) and loses its low temperature upon touching the (skin) surface. Compared to the indirect cooling alternatives, e.g. Peltier elements, the present invention is more cost-efficient.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

A computer program may be stored/distributed on a suitable medium, such as an optical storage medium or a solid-state medium supplied together with or as part of other hardware, but may also be distributed in other forms, such as via the Internet or other wired or wireless telecommunication systems.

Any reference signs in the claims should not be construed as limiting the scope.

The invention claimed is:

1. A body care system for cooling a body part, comprising:

a brush unit including a plurality of airflow generating structures extending radially outwards with respect to a rotational axis of the brush unit;

a driving unit configured to drive the brush unit to rotate said brush unit about its rotational axis to generate, by the rotational motion of the airflow generating structures, an airflow in order to evaporate a cooling medium, wherein the rotational axis is configured to be substantially parallel to a surface of the body part during application of the body care system;

a connecting unit connecting the brush unit to the driving unit;

a supplying unit arranged inside the brush unit for supplying the cooling medium to the plurality of airflow generating structures of the brush unit; and a brush housing at least partially covering an outer surface of the brush unit, such that the surface of the body part to be cooled during application of the body care system and the brush unit covered by the brush housing are physically separated from each other by a part of the brush housing during application of the body care system.

2. The body care system according to claim 1, wherein the brush housing comprises a thermal conducting material.

3. The body care system according to claim 2, wherein the thermal conducting material comprises a metal.

4. The body care system according to claim 2, wherein the thermal conducting material has a thermal conductivity that is within a range from 20 to 400 W/(m·K).

5. The body system according to claim 2, wherein the thermal conducting material has a specific heat capacity that is within a range from 0.35 to 0.95 J/g·° C.

6. The body care system according to claim 1, wherein the brush housing is formed to receive the brush unit from a body-facing side of the brush unit, the brush housing comprising a body-facing outer surface for covering the body-facing side of the brush unit, wherein the body-facing outer surface of the brush housing and the body-facing side of the brush unit are both facing towards the body part to be cooled during application of the body care system.

7. The body care system according to claim 6, wherein the body-facing outer surface of the brush housing is flat or curved or flexible.

8. The body care system according to claim 1, wherein the brush housing comprises at least one air venting opening.

9. The body care system according to claim 8, wherein the at least one air venting opening comprises a lateral air venting opening.

10. The body care system according to claim 1, further comprising a thermal connector attached to a body-facing side of the brush housing which is facing towards the body part to be cooled during application of the body care system, wherein the thermal connector is configured to thermally connect the brush housing to an epilator or shaving element.

11. The body care system according to claim 10, further comprising a contact element for contacting a body part of a user, the contact element being attached to or belonging to the thermal connector.

12. The body care system according to claim 1, wherein the supplying unit comprises a reservoir containing the cooling medium.

13. The body care system according to claim 12, further comprising another reservoir arranged within the housing of the body care system.

* * * * *